United States Patent [19]

Healey et al.

[11] 4,356,476

[45] Oct. 26, 1982

[54] MULTIPLE ALARM DETECTOR MONITORING AND COMMAND SYSTEM

[75] Inventors: William E. Healey, Bloomfield Hills, Mich.; Morse R. Heineman, White Rock, N. Mex.

[73] Assignee: W. E. Healey & Associates, Inc., Bloomfield Hills, Mich.

[21] Appl. No.: 187,355

[22] Filed: Sep. 15, 1980

[51] Int. Cl.[3] ..... G08B 19/00

[52] U.S. Cl. ..... 340/522; 340/506; 340/508; 340/511; 340/510

[58] Field of Search ..... 340/522, 521, 519, 520, 340/500, 506, 508, 509, 511, 523, 524, 534, 537, 510

[56] References Cited

U.S. PATENT DOCUMENTS

| | | | |
|---|---|---|---|
| 3,599,195 | 8/1971 | Boyko | 340/521 |
| 4,103,293 | 7/1978 | La Forge | 340/522 |
| 4,195,286 | 3/1980 | Galvin | 340/522 |
| 4,204,201 | 5/1980 | Williams et al. | 340/521 |

*Primary Examiner*—John W. Caldwell, Sr.

*Assistant Examiner*—Donnie L. Crosland

*Attorney, Agent, or Firm*—Cullen, Sloman, Cantor, Grauer, Scott & Rutherford

[57] ABSTRACT

A plurality of fire, smoke, security or other detectors of the type which respond to the existence of a predetermined condition are each connected to an input module which monitors the state of the detectors. The input module is connected to an alarm module and when a predetermined number of detectors simultaneously detect the existence of fire, smoke or a breach in security or the like, the alarm module provides a suitable preselected command to sound an alarm, commence an interlock and/or activate a predetermined management decision to activate other devices for fire or security protection, such as the automatic discharge of an extinguishing agent, etc. The alarm module may provide different commands depending upon the number of detectors which are simultaneously triggered. In addition, certain preselected detectors may cause the alarm module to provide a command signal regardless of the number of detectors which are simultaneously triggered.

15 Claims, 4 Drawing Figures

MULTIPLE ALARM DETECTOR MONITORING AND COMMAND SYSTEM

BACKGROUND OF THE INVENTION

This invention relates generally to detector and alarm systems and, more particularly, to an improved system which responds to a predetermined number of simultaneous detectors being triggered, and/or to pre-selected detectors being triggered.

There are various types of detector systems presently being marketed such as flame detectors, smoke detectors, unauthorized entry detectors, etc. These detectors are typically connected to provide a suitable output such as an audible signal, or to turn on a sprinkler system, etc., when a detector is activated. In certain environments, such as a room filled with computers or other sensitive electronic equipment, smoke detectors are normally provided and, when smoke is sensed by a detector, a chemical agent such as HALON 1301 is automatically released to extinguish any fire. HALON 1301 is well known in that it provides a chain breaking reaction to extinguish a fire without damaging the sensitive computer or other electronic equipment. The phrase "striking point" is often used to indicate the response to a detector being triggered. Thus in the aforementioned example, the triggering of a single detector in a cross-zoned detection system or a priority matrix detection system is referred to as the "striking point" in response to which HALON 1301 would be discharged into a computer room.

It is well known that various types of detectors may be extremely sensitive and, for example, smoke detectors in a computer room, office or the like may be triggered by pipe, cigar or cigarette smoke rather than by the type of smoke which indicates the existence of an uncontrolled fire for which HALON 1301 should be discharged. As another example, in a residential "burgular alarm" system, e.g., a system which detects unauthorized entry into a house, the rattling of a window from wind vibration or the breaking of a window in and of itself should not indicate a "striking point". Thus it may be appreciated that there are many instances where the triggering of a detector does not truly indicate that any action should be taken.

We have discovered that there are many situations in the commercial, residential and industrial uses of detectors where the "striking point" is not needed until a plurality of detectors are actuated simultaneously. Prior to the present invention, no simple system has been developed for recognizing and/or properly responding to such a "striking point". We have also discovered that where a plurality of detectors are used, triggering of certain detectors might indicate that a "striking point" is needed while triggering of other detectors would not justify a "striking point".

SUMMARY OF THE INVENTION

The present invention overcomes the shortcomings of the prior art by providing a system to monitor the status of a plurality of alarm detectors and for providing a command signal only when selected detectors and/or a plurality of detectors are simultaneously triggered. Thus, for example, in a room having computer equipment, desks, files, etc. an arbitrary number of smoke detectors would have to be actuated simultaneously or alternatively a detector positioned directly above the computer would have to be actuated to achieve a "striking point" resulting in the automatic release of an extinguishing agent such as HALON 1301.

The present system provides a plurality of input modules or circuits, each associated with and responsive to a different detector. The detectors, of course, would be located throughout the room or building being protected. An alarm module or circuit receives signals from the plurality of input modules and only when a predetermined management decision for specific signals or a fixed number of such signals occurs, simultaneously or when pre-selected detectors are actuated, would action be taken affirmatively to respond. Thus, for example, in a large room, the striking point might be established as the simultaneous detection of smoke by two, three, four or more detectors. Hence no action would be taken if only one detector is triggered.

The present invention further provides for different responses to be taken based upon the number of detectors which are actuated. Thus, as an example, when only one detector is actuated, a visible display could be illuminated; if two detectors were actuated simultaneously an audible signal could be sounded. In response to the audible signal personnel would be dispatched to the area in question to determine the cause of the actuation of the detectors. If three detectors were actuated simultaneously, then an extinguishing agent such as HALON 1301 could be automatically discharged in the region where the detectors were actuated.

It should be appreciated, therefore, that the present invention may be used in commercial, industrial and residential environments. Similarly, the detectors need not be of the same type in that a single system could have detectors which respond to smoke, fire, heat, pressure, movement and sound. Finally, the type of command or action may vary based upon the particular use of the alarm system. As examples, in a computer room, HALON 1301 could be discharged; in a warehouse, sprinklers could be automatically actuated; in a residence, an automatic telephone dialer could be used to contact the fire department; and in the case of a central alarm station a varied number of detectors could cause a varied command decision or course of action.

BRIEF DESCRIPTION OF THE DRAWINGS

The foregoing objects and advantages of the present invention together with other objects and benefits which may be attained by its use, will become more apparent upon reading the following detailed description of the invention taken in conjunction with the drawings.

In the drawings, wherein like reference numerals identify corresponding parts.

DETAILED DESCRIPTION OF THE INVENTION

Figure 1:
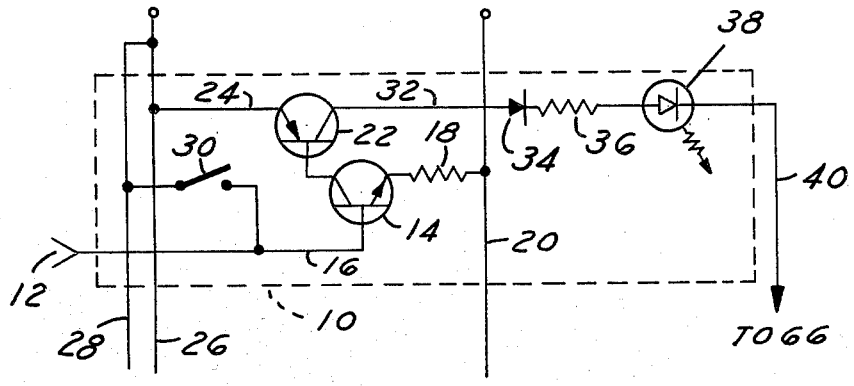
FIG. 1 is a circuit diagram of a single input module which is associated with a single detector.

With reference to the drawings, FIG. 1 illustrates a schematic diagram of an individual input circuit or module 10. The input module 10 is associated with a single detector (not shown) and when the detector is triggered, a positive signal is applied to the input circuit at input terminal 12. The input module 10 includes a first NPN transistor 14 having a base connected by lead 16 to the input terminal 12. The emitter of transistor 14 is connected through a resistor 18 to a bus 20 which is the common bus for a 24 volt d.c. power supply. The collector of transistor 14 is connected to the base of a PNP transistor 22. The emitter of transistor 22 is connected via lead 24 to a bus 26 which is the positive bus for this system and is provided with a positive 24 volt d.c. In the present system, the voltages are provided by direct current through a regulated power supply. In parallel with bus 24 is a second bus 28, also receiving plus 24 volts d.c. A switch 30 is connected between bus 28 and lead 16 to the base of the transistor 14 and the closing of the switch 30 simulates the presence of an input signal from the detector at terminal 12 by providing a positive voltage to the base of transistor 14.

The collector of transistor 22 is coupled on lead 32 to one side of a diode 34. The other side of diode 34 is connected to one side of resistor 36 and the opposite side of resistor 36 may be coupled to one side of a light emitting diode (LED) 38. The opposite side of the LED 38 is connected to an output bus 40. The use of LED 38 is optional in the present invention.

The operation of the input circuit of FIG. 1 will now be explained. In response to a positive input signal at the input terminal 12, a positive signal is supplied to the base of transistor 14 causing transistor 14 to conduct and to invert the input signal thus providing a negative signal to the base of transistor 22. The negative signal at the base of transistor 22 causes transistor 22 to conduct and to invert the input signal thus providing a positive output signal on lead 32. The positive signal on lead 32 illuminates the LED 38 and provides a positive output signal on bus 40 having an approximate magnitude of plus 2.5 volts d.c. Thus it may be seen that the presence of an input signal from a detector to the circuit of the input module 10 results in a positive 2.5 volt d.c. output signal on bus 40. The 2.5 volt signal on bus 40 may alternatively be referred to as having the value (magnitude) "1".

The switch 30, when closed, couples the positive 24 volt input on bus 28 to lead 16 and to the base of transistor 14 thus simulating an input signal at the input terminal 12. The switch 30 may be used for testing the operation of the input module to verify that all the circuit components are operating properly.

According to the principles of the present invention, a plurality of input modules 10 are provided, and each is connected to and associated with one detector. The present invention thus provides a plurality of input modules 10 each of which monitors a particular detector. When a predetermined number of detectors are actuated simultaneously, one feature of the present invention recognizes that the "striking point" is needed and provides a suitable command or output signal as will now be described.

According to the present invention, means 50 is provided to recognize that the "striking point" is needed and for providing a suitable command signal. The means 50 is an alarm module illustrated in FIG. 2 and is connected to a positive 24 volt d.c. input bus 52 and a d.c. common bus 54. A resistor 56 has one side connected to the input bus 52 and its opposite side connected to one side of an LED 58. The other side of the LED 58 is connected to one side of a relay 60 and the opposite side of the relay 60 is connected to the negative input bus 54. A pair of diodes 62, 64 are connected in series with each other and in parallel across the relay 60 to prevent any counter EMF from being developed through the coil of the relay 60.

The alarm module 50 of the present invention receives an input signal on lead 66 from the output bus 40 of the input module 10. Lead 66 is connected to one side of a resistor 68 and the opposite side of the resistor 68 is connected to the base of a first NPN transistor 70. The emitter of transistor 70 is connected to the base of a second NPN transistor 72 and the emitter of transistor 72 is connected via lead 74 to a potentiometer 76. Lead 74 actually serves as the adjustment blade of the potentiometer. One side of potentiometer 76 is connected to one side of a resistor 78 the other side of which is connected to the positive bus 52. The opposite side of potentiometer 76 is connected to the d.c. common bus 54. Another resistor 80 is connected between the common bus 54 and the input lead 66.

The collector of transistor 70 is connected to the collector of transistor 72 and also to one side of a resistor 82 and the other side of resistor 82 is connected to one side of a resistor 84. The opposite side of resistor 84 is connected to the positive bus 52 and the junction of resistors 82 and 84 is connected to the base of a PNP transistor 86. The emitter of transistor 86 is connected to the positive bus 52 and the collector of transistor 86 is connected to one side of a resistor 88. The opposite side of resistor 88 is connected to one side of a LED 90 and the opposite side of LED 90 is connected to the common bus 54. A diode 92 is connected from the collector if transistor 86 to the junction of LED 58 and relay 60.

Figure 2:
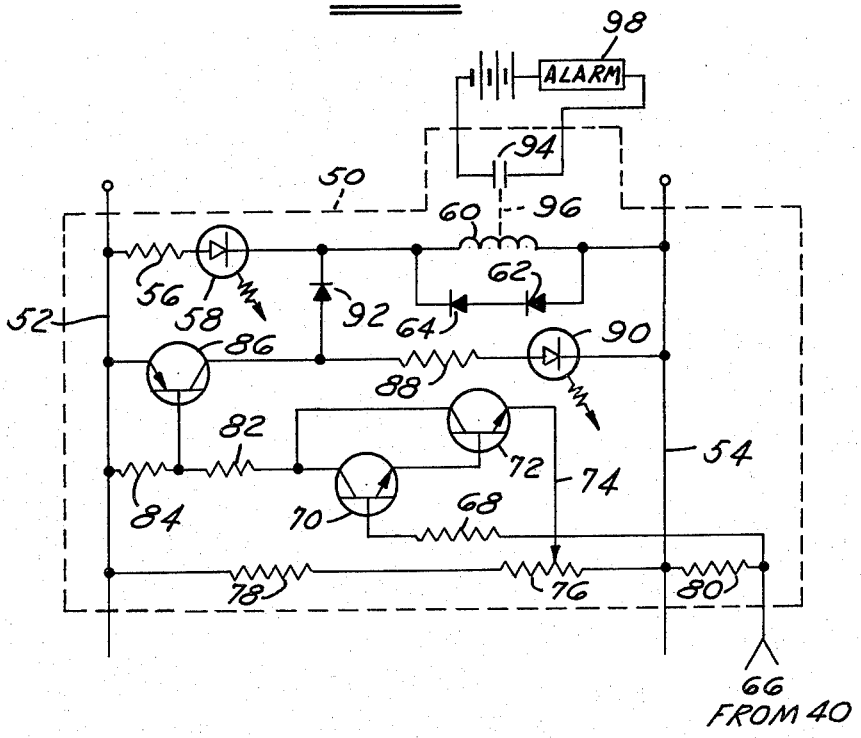
FIG. 2 is a schematic diagram of a single command module which provides an output signal in response to the simultaneous actuation of a preselected detector or a predetermined number of detectors.

The operation of the alarm module or circuit 50 of FIG. 2 will now be explained. In the absence of a signal on input lead 66, the transistors 70, 72 and 86 are all quiescent or non-conducting. LED 58 is on, power is provided to the normally closed relay coil 60 and LED 90 is off. LED 58 being on verifies that the relay coil 60 is closed (i.e., de-energized) and when coil 60 is either open (i.e., energized) or removed the LED 58 will switch off. The relay coil 60 is connected to a normally open relay contact 94, the connection represented by the dotted line 96. When contacts 94 close, the command signal or alarm 98 is actuated.

In response to input signal on lead 66 from bus 40, a positive signal is applied on lead 66 to the base of transistor 70. Assume that the potentiometer 76 is adjusted so that the transistor 70, 72 and 86 will not switch to their conducting state unless at least 5 volts is supplied on lead 66. Since an input module provides a 2.5 volt output signal on bus 40, there would be no response from the alarm module 50 to a 2.5 volt input signal on lead 66.

Now assume that the potentiometer 76 is adjusted so that a 2.5 volt signal is sufficient to switch the transistors on. A signal on bus 40 to lead 66 provides a 2.5 volt input to the base of transistor 70, thus switching on transistor 70 and transistor 72. These two transistors turn on at essentially the same time. As transistor 70 turns on, current flows from bus 52 through transistor 70 to the base of transistor 72 and through transistor 72, through the potentiometer to the d.c. common bus 54 thus providing a complete circuit. With transistor 70 and transistor 72 both conducting, transistor 86 is switched on thus providing current flow through transistor 86. The current flow breaks into two parallel paths, the first path through resistor 88 and LED 90 to illuminate LED 90. The second parallel path is through diode 92 and relay 60 to energize relay 60 thus closing relay contact 94 to actuate an alarm or command signal 98.

Having thus explained how an individual input module 10 operates with respect to FIG. 1 and how an individual alarm module 50 operates, with respect to FIG. 2 reference should now be had to FIG. 3 where a complete system will now be described. The system of FIG. 3, which operates according to the principles of the present invention, has a plurality of input modules 10*a*, 10*b*, 10*c* . . . 10*x* . . . 10*n* connected in parallel. Each input module has its own input terminal 12*a*, 12*b*, 12*c*, etc. Each of the input modules 10*a*–10*n* is connected between the positive 24 power bus 26, 28 and the common bus 20. Each input module 10 is coupled to the output bus 40.

Figure 3:
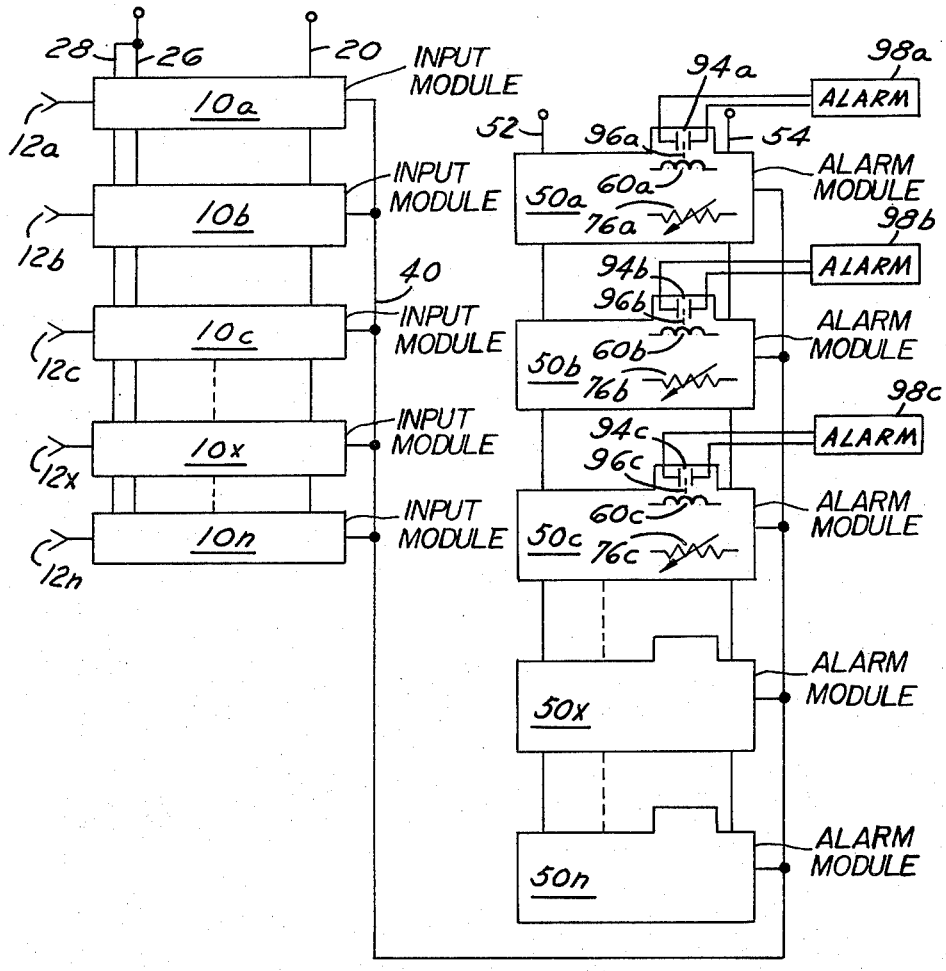
FIG. 3 is a block diagram of a plurality of input modules and a plurality of command modules.

The system of FIG. 3 also includes a plurality of parallel alarm modules 50*a*, 50*b* . . . 50*x* . . . 50*n*, each connected between positive bus 52 and common bus 54. Each of the plurality of alarm modules 51*a*, 50*b* . . . also receives an input signal on lead 66*a*, 66*b* . . . respectively, from the output bus 40 of the input modules.

To further understand the operation of the alarm modules of FIG. 3, assume that module 50*a* has its potentiometer 76*a* adjusted to respond to a single detector being actuated, alarm module 50*b* has its potentiometer 76*b* adjusted to respond to two simultaneous detectors being actuated and alarm module 50*c* has its potentiometer 76*c* adjusted to respond to the simultaneous triggering of four detectors. In other words, an output of 2.5 volts from any one input module would actuate alarm module 50*a*, an output of 5.0 volts (i.e., any two input modules simultaneously) would actuate alarm modules 50*a* and 50*b*, and an output of 10.0 volts (i.e., any four input modules simultaneously) would actuate alarm modules 50*a*, 50*b*, and 50*c*. The relay 60*a* associated with alarm module 50*a* might be connected to a flashing light 98*a* on a control panel, relay 60*b* associated with alarm module 50*b* might be connected to a horn or other audible signal 98*b* at a control panel and relay 60*c* associated with alarm module 50*c* might be connected to a system 98*c* for automatically discharging a fire extinguishing agent such as HALON 1301.

Assume that a single detector is triggered in response to smoke in the area being monitored by the detector. One input module would provide an output on bus 40 of 2.5 volts which would be sufficient to activate only alarm module 50*a* and thus a flashing light alarm 98*a* would be illuminated on a control panel but no other action would be taken. At a later time, assume that two detectors were simultaneously triggered. Two input modules would provide output signals of 2.5 volts each resulting in a positive 5.0 voltage on bus 40. The positive 5 volts on bus 40 would be sufficient to actuate alarm modules 50*a* and 50*b*. Actuation of alarm module 50*a*, would, of course, close its associated relay contacts and thus illuminate a flashing light and simultaneously actuation of alarm module 50*b* would result in an audible signal 98*b*. Such an audible signal could, of course, result in personnel looking at the control panel, determining which LED 38*a*, 38*b*, etc., are illuminated to determine the location of the detectors which were triggered and inspecting such area to determine the cause of the detectors being triggered.

Assume lastly that four detectors are triggered simultaneously thus causing four of the input modules to each provide 2.5 volt output signals. In such a circumstance, the voltage on bus 40 would be 10 volts which would be sufficient to actuate alarm modules 50*a*, 50*b* and 50*c*. The result would be the illumination of a flashing light 98*a* and the sounding of an audible signal 98*b*. The result of actuating alarm circuit 50*c* would be closing its associated relay contacts resulting in the automatic discharge of a fire extinguishing agent 98*c*.

In the preceding explanation, each input module 10 provides a positive 2.5 volt output. For the purposes of further explanation, assume that a positive 2.5 volt output has a value of "1". Thus when the two detectors are simultaneously triggered, two different input modules will each provide an output value of "1" and a total output value, on bus 40 would be 5.0 volts or a value of "2". Thus, in the example of FIG. 3, an output value of "2" would be sufficient to actuate alarm modules 50*a* and 50*b*, but not alarm module 50*c*.

In some instances, actuation of a preselected detector might be sufficient to justify a striking point. For example, in a large room having computers, desks, files and the like, a "striking point" may be needed if a smoke or fire detector positioned directly above a computer is triggered whereas a striking point may not be needed if a detector in a place within the room remote from the computer is triggered.

According to the principles of the present invention, a second feature of the present invention contemplates certain detectors having an output greater than the value "1", i.e., an output greater than 2.5 volts. For example, the appropriate reduction of the value of resistor 36 in an individual input module 10 yields a larger output voltage on bus 40.

For example, reducing the value of the resistors 36 of input module 10*c* associated with the smoke detector positioned directly above a computer could yield an output signal on bus 40 of 10.0 volts or a value of "4". This value, according to the prior explanation, would be sufficient to actuate alarm modules 50*a*, 50*b* and 50*c* thus automatically discharging a fire extinguishing agent.

Hence, it should be appreciated and understood that the present invention contemplates two features; the first feature being that a preselected number of detectors triggered simultaneously will provide the total "value" necessary to reach a striking point and, the second feature being that preselected detectors themselves may provide a sufficient output or "value" to reach the striking point while other detectors may not provide a sufficiently high "value".

Thus the in the present invention, the "value" associated with a given input module refers to the magnitude of the output signal from such module when its associated detector is triggered. In effect, this permits a "weighting" of detectors in that some detectors may have a greater impact on whether a "striking point" is needed than other detectors. The alarm modules, in effect, respond to the combined "value" or voltage magnitude from the plurality of input modules.

Figure 4:
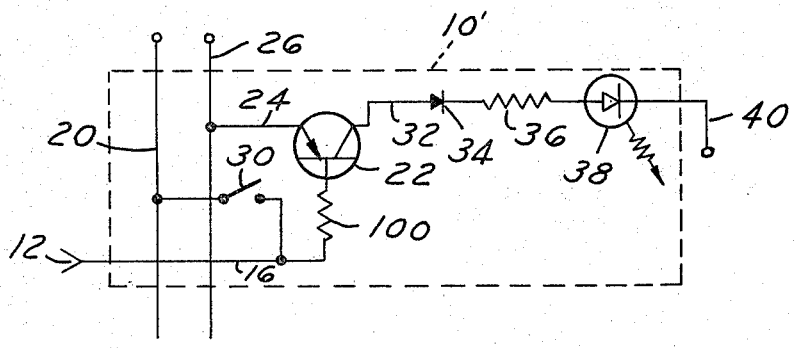
FIG. 4 is a schematic diagram of an alternate embodiment of the input module of FIG. 1.

It has been assumed, in the discussion of the circuit of FIG. 1, that the detector provides a positive signal on lead 12 to the input module associated with such detector. Many detectors, however, provide a negative output signal rather than a positive output signal when triggered. FIG. 4 illustrates a suitable input module 10' to be utilized in conjunction with such a detector. The input circuit 10' of FIG. 4 wil now be explained.

Input circuit 10' has an input terminal 12 which receives an input signal from its associated detector (not shown). The input signal at terminal 12 is connected along lead 16 to one side of a resistor 100. The opposite side of resistor 100 is connected to the base of the PNP transistor 22. The emitter of transistor 22 is connected via the lead 24 to the positive 24 volt d.c. bus 26. The collector of transistor 22 is connected on lead 32 through diode 34 resistor 36 and LED 38 to the output bus 40 in the same manner as the input module 10 of FIG. 1. A negative input signal at terminal 12 for this circuit 10' of FIG. 4 causes transistor 22 to conduct and invert the negative signal to a positive signal at the collector of transistor 22 which positive signal thus provides the positive output on output bus 40. In the circuit 10' of FIG. 4, the d.c. common bus 20 is connected to one side of the test switch 30 and the opposite side of the test switch 30 is connected to lead 16. Hence the common bus 20 in the embodiment of FIG. 4 provides an input signal for system test purposes.

The foregoing is a complete description of the present invention. Many changes and modifications may be made by those skilled in the art without departing from the spirit and scope of the present invention. The present invention, therefore, should be limited only by the following claims.

What is claimed is:

1. In an alarm system of the type including a plurality of detectors, each detector having an untriggered condition and a triggered condition, the triggered condition indicating that the detector has sensed a condition for which an alarm should be indicated, the improvement comprising:

a plurality of input modules, each associated with and electrically connected to one detector, each input module being capable of providing an output signal having a pre-selected (value) voltage level only when the detector associated therewith is in a triggered condition; and alarm command means electrically connected to and receiving said output signals from all of said plurality of input modules, said alarm command means being capable of providing a command signal only when said input modules are simultaneously providing output signals and said output signals having a sum of at least a predetermined voltage level.

2. The invention as defined in claim 1 wherein all of said input modules receive positive signals when the detectors associated therewith are in a triggered condition.

3. The invention as defined in claim 1 wherein each of said input modules is capable of providing an output signal of the same pre-selected voltage level, said first predetermined voltage level occurring only when a predetermined number of input modules are simultaneously providing said output signals.

4. The invention as defined in claim 1 where only some of said input modules receive positive signals when the detectors associated therewith are in a triggered condition.

5. The invention as defined in claim 1 wherein each input module includes test means to simulate the triggered condition of the detector associated therewith.

6. The invention as defined in claim 1 wherein each input module also provides a visible output signal when the detector associated therewith is in a triggered condition.

7. The invention as defined in claim 1 wherein said alarm command means is a plurality of alarm modules, said plurality of alarm modules being responsive to at least two different sums of output signal voltage levels from said plurality of input modules.

8. The invention as defined in claim 1 wherein said alarm command means provides different command signals depending upon the voltage level of the sum of the output signals from said input modules.

9. The invention as defined in claim 8 wherein said alarm command means includes at least two alarm command modules, said first alarm command module being capable of providing a command signal only when the input modules are simultaneously providing output signals, and said output signals having a sum of at least a first predetermined voltage level, and said second alarm command module being capable of providing a second command signal only when the input modules are simultaneously providing output signals, and said output signals having a sum of at least a second predetermined voltage level.

10. The invention as defined in claim 9 wherein each of said first and second predetermined voltage levels are adjustable.

11. The invention as defined in claim 9 wherein said first and second predetermined voltage levels are different.

12. The invention as defined in clalm 1 wherein said alarm command means includes a first visible signal when said alarm command means is not providing a command signal.

13. The invention as defined in claim 1 wherein said alarm command means provides a second visible output signal simultaneously with said command signal.

14. The invention as defined in claim 1 wherein said predetermined voltage level is adjustable.

15. In an alarm system of the type including a plurality of detectors, each detector having an untriggered condition and a triggered condition, the triggered condition indicating that the detector has sensed a condition for which an alarm should be indicated, the improvement comprising:

a plurality of input modules, each associated with and electrically connected to one detector, each input module being capable of providing an output signal having a pre-selected voltage level only when the detector associated therewith is in a triggered condition; and alarm command means comprising at least two alarm command modules each of which is electrically connected to and receiving output signals from all of said plurality of input modules;

said first alarm command means being capable of providing a command signal only when said input modules are simultaneously providing output signals having a sum of a first predetermined voltage level; and said second alarm command means being capable of providing a command signal only when said input modules are simultaneously providing output signals having a sum of a second predetermined voltage level.

* * * * *